US005873664A

United States Patent [19]

Umemo

[11] Patent Number: 5,873,664

[45] Date of Patent: Feb. 23, 1999

[54] PRINTER APPARATUS

[75] Inventor: Hideyuki Umemo, Kawasaki, Japan

[73] Assignee: Fujitsu Limited, Kanagawa, Japan

[21] Appl. No.: 985,279

[22] Filed: Dec. 4, 1997

[30] Foreign Application Priority Data

Jun. 13, 1997 [JP] Japan ..... 9-156199

[51] Int. Cl.[6] ..... B41J 11/42

[52] U.S. Cl. ..... 400/579; 400/630; 271/236; 271/246

[58] Field of Search ..... 400/579, 630, 400/631, 632, 632.1, 636; 271/227, 226, 235, 236, 245, 246, 248

[56] References Cited

U.S. PATENT DOCUMENTS 5,083,879 1/1992 Sato et al. ..... 400/579
5,088,848 2/1992 De Falco et al. ..... 400/579

FOREIGN PATENT DOCUMENTS 2-23135 1/1990 Japan .
4-22657 1/1992 Japan .

*Primary Examiner*—Ren Yan
*Attorney, Agent, or Firm*—Armstrong, Westerman, Hattori, McLeland & Naughton

[57] ABSTRACT

Disclosed is a printer apparatus for correcting a slant of a medium at a medium insertion port. This printer apparatus corrects slants of the mediums having a variety of thicknesses. The printer apparatus comprises a slant correcting mechanism for correcting the slant of the medium inserted, a conveying roller for conveying the medium the slant of which is corrected, and a printing mechanism for executing a print on the medium conveyed by the conveying roller. This slant correcting mechanism includes a plurality of polygonal rollers, having rotational phases different from each other, for conveying the medium, and an impingement member upon which the medium conveyed by the polygonal rollers impinges.

8 Claims, 19 Drawing Sheets

PRINTER APPARATUS

BACKGROUND OF THE INVENTION

1. Field of the Invention

The present invention relates generally to a printer apparatus for correcting a slant of a medium at a medium insertion port and, more particularly, to a printer apparatus for correcting slants of many kinds of mediums.

2. Description of the Related Art

A printer apparatus is used for executing a print on a medium such as a passbook, a check and a slip etc in, e.g., a financial institute etc. In this kind of printer apparatus, if the medium is inserted obliquely, the printing is effected obliquely. It is required that an operator should set the medium in a right position at the insertion port in order to prevent the slant of the medium.

When the operator implements this setting operation, however, the operator might be burdened with this operation. Such a printer apparatus is therefore provided with an automatic setting mechanism for correcting the slant of the medium. This automatic setting mechanism automatically corrects the slant of the medium after the operator has inserted the medium from the medium insertion port. This type of printer apparatus, it is desired, should stably correct the slant of the medium regardless of the thickness thereof.

FIG. 19 is an explanatory view showing the prior art.

As shown in FIG. 19, in the printer apparatus, the medium inserted from an insertion port 90 is conveyed by conveying rollers 92, 93. Then, a printing head 95 effects a print on the medium. After finishing the printing, the medium is returned to the insertion port 90.

A slant correcting roller 91 for correcting the slant of the medium is provided at the insertion port 90. This kind of slant correcting mechanism is disclosed in Japanese Patent Application Laid-Open Publication Nos.4-22657 and 2-23135. The slant correcting roller 91 makes the inserted medium impinge on an impingement member 94. This slant correcting roller 91 is constructed to stop the conveyance of the medium after the impingement of the medium. Therefore, the slant correcting roller 91 is constructed of polygonal rollers. The roller 91 is constructed of, e.g., a square roller.

A single piece of polygonal roller has hitherto been provided at the insertion port 90. Then, the one polygonal roller causes the medium to impinge upon the impingement member 94, thus correcting the slant thereof.

In the case of using a variety of mediums having different sizes, however, there arises a problem in which it is difficult to make the mediums of all the sizes impinge upon the impingement member.

Further, the printer apparatus deals with the mediums having a variety of thicknesses, i.e., a thick medium such as a passbook and a thin medium such as a slip. An impingement of the thick medium requires a comparatively large conveying force. If the impingement of the thin medium is caused by this conveying force, the thin medium might be bounced back after the thin medium has impinged upon the impingement member. This therefore presents a problem in which the slant of the thin medium is hard to correct.

SUMMARY OF THE INVENTION

It is a primary object of the present invention to provide a printer apparatus for correcting slants of mediums having a verity of sizes.

It is another object of the present invention to provide a printer apparatus for correcting the slants of the medium having a variety of thicknesses.

It is still another object of the present invention to provide a printer apparatus for preventing the medium being bounced back.

To accomplish the above objects, a printer apparatus according to the present invention executes a print on a medium inserted from an insertion port. This printer apparatus comprises a slant correcting mechanism for correcting a slant of the medium inserted, a conveying roller for conveying the medium the slant of which is corrected, and a printing mechanism for executing the print on the medium conveyed by the conveying roller.

Then, the slant correcting mechanism includes a plurality of polygonal rollers having rotational phases different from each other, and an impingement member upon which the medium conveyed by the polygonal rollers impinges.

According to the present invention, firstly, a plurality of polygonal rollers are provided. These polygonal rollers are capable of causing impingements of the mediums with a stability irrespective of their widths. Secondly, the plurality of polygonal rollers are set to have different rotational phases. Namely, phases of conveyances by the polygonal rollers are respectively set different. With this setting, the widthwise right and left portions of the medium are respectively conveyed and thus impinges upon the impingement member.

Accordingly, one side of the medium is conveyed by the first polygonal roller, and one side of the medium impinges thereon. When one side of the medium impinges thereon, the first polygonal roller slides. At this time, the other polygonal roller conveys the other side of the medium. Then, when the other side of the medium impinges thereon, the other polygonal roller slides. Such motions of the right and left edges of the medium are conducted with a time-lag, and therefore a force for conveying the medium at one time decreases. Further, since the right and left edges of the medium are conveyed with the time-lag by the small conveying force, a thin medium can be prevented from being bounced back when in the impingement. Hence, the slant of the medium can be stably corrected regardless of its thickness.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
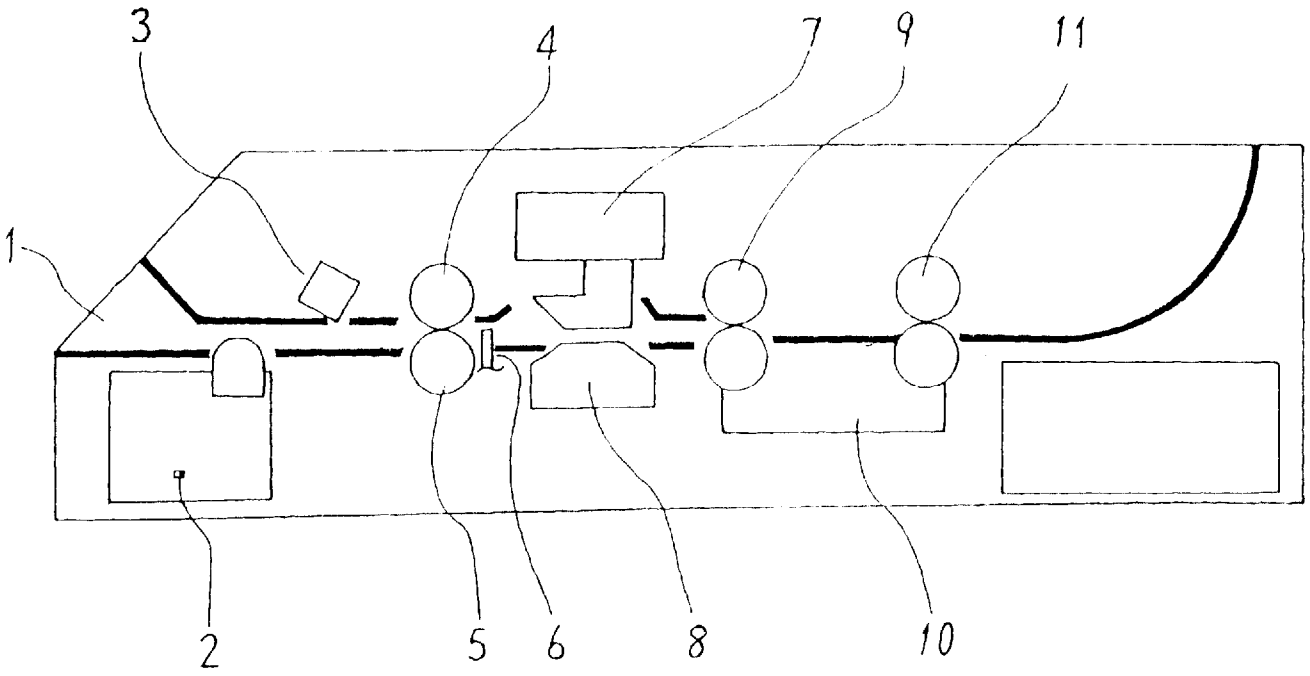
FIG. 1 is a view showing a construction of a printer apparatus in one embodiment of the present invention.

FIG. 1 is a view illustrating a construction of a printer apparatus in one embodiment of the present invention.

As illustrated in FIG. 1, a medium insertion port 1 is a port into which a medium such as a passbook and a slip etc is inserted. A magnetic stripe reader/writer 2 reads data from a magnetic stripe of the passbook and writes the data to the magnetic stripe. A polygonal roller 3 is constructed of a square roller. The square roller 3 rotates to modify a slant of the medium inserted. A conveying roller 4 conveys the inserted medium. A pinch roller 5 conveys the medium with the medium sandwiched in between conveying roller 4 and the pinch roller 5 itself.

The medium impinges upon an impingement plate 6 when correcting the slant of the medium. A printing head 7 performs a print on the medium. A platen 8 supports the medium when in the printing process. Conveying roller 9 convey the medium. A page turn-over mechanism 10 turns over pages of the passbook. Conveying rollers 11 convey the medium.

An operation of this printer apparatus will be explained. The medium inserted into the medium insertion port 1 is conveyed by the polygonal roller 3, and impinges upon the impingement plate 6. A slant of the medium is thereby corrected. Next, the medium is conveyed by the conveying rollers 4, 5. The medium is subjected to the printing by the printing head 7 and thereafter returned to the medium insertion port 1.

If the medium is classified as a passbook, the data on the magnetic strip of the passbook is read by the magnetic stripe reader/writer 2. Further, if the page is required to be turned over, the page turn-over mechanism 10 turns the page over.

Figure 2:
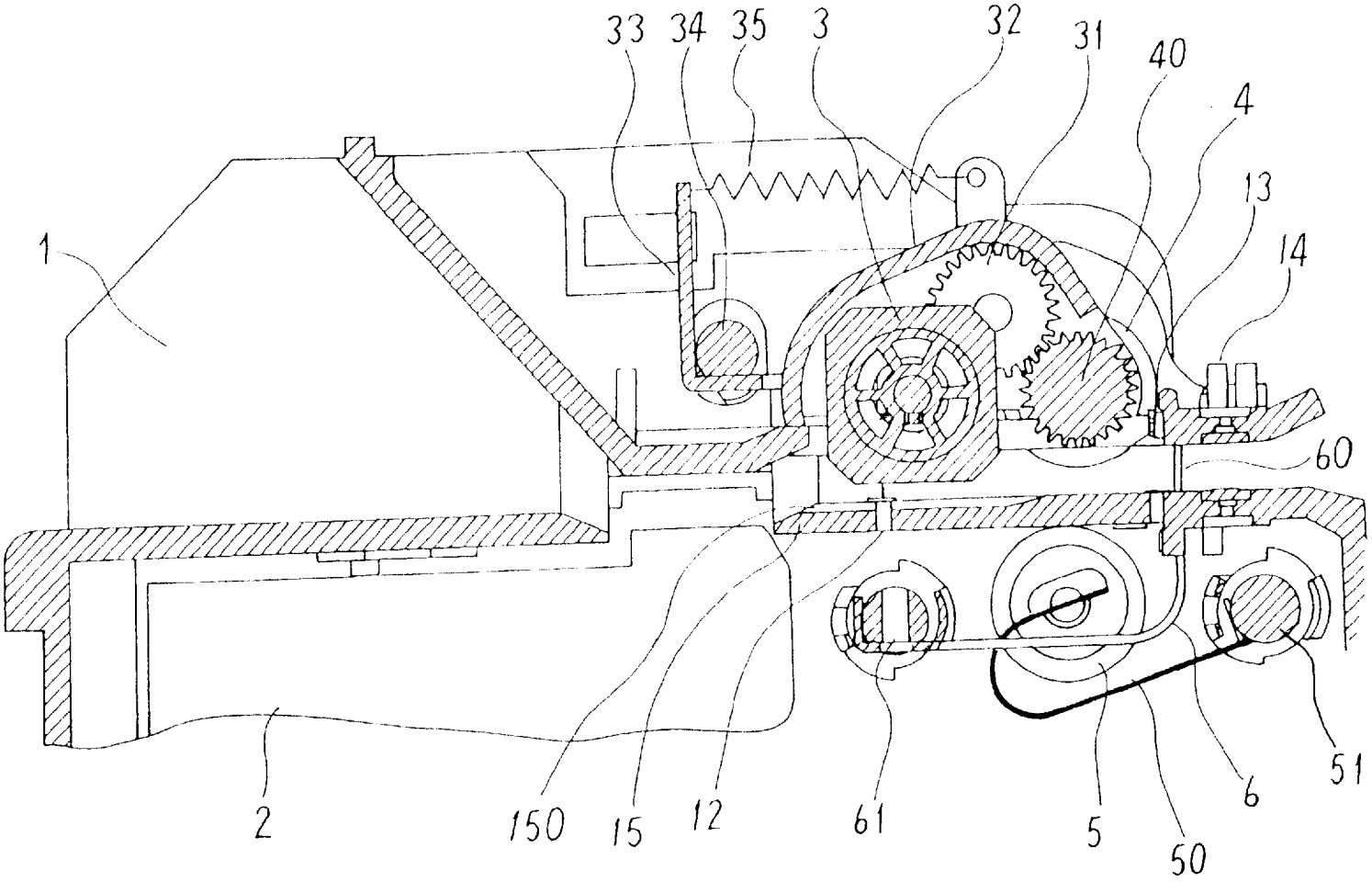
FIG. 2 is a sectional view of a medium inserting unit in FIG. 1.
Figure 3:
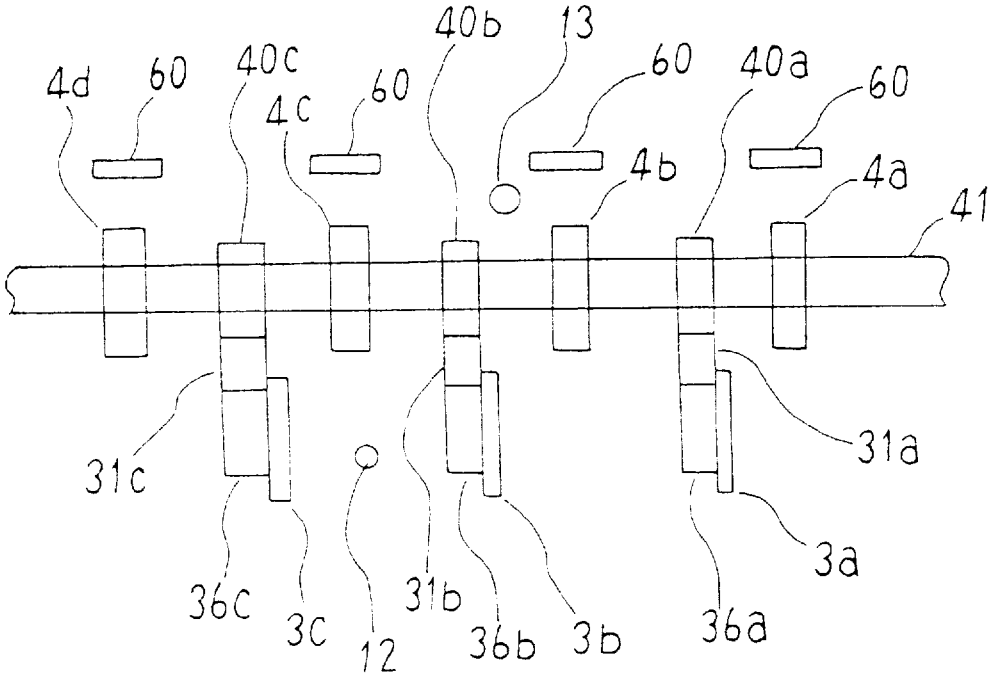
FIG. 3 is a top view of the medium inserting unit in FIG. 1.
Figure 4:
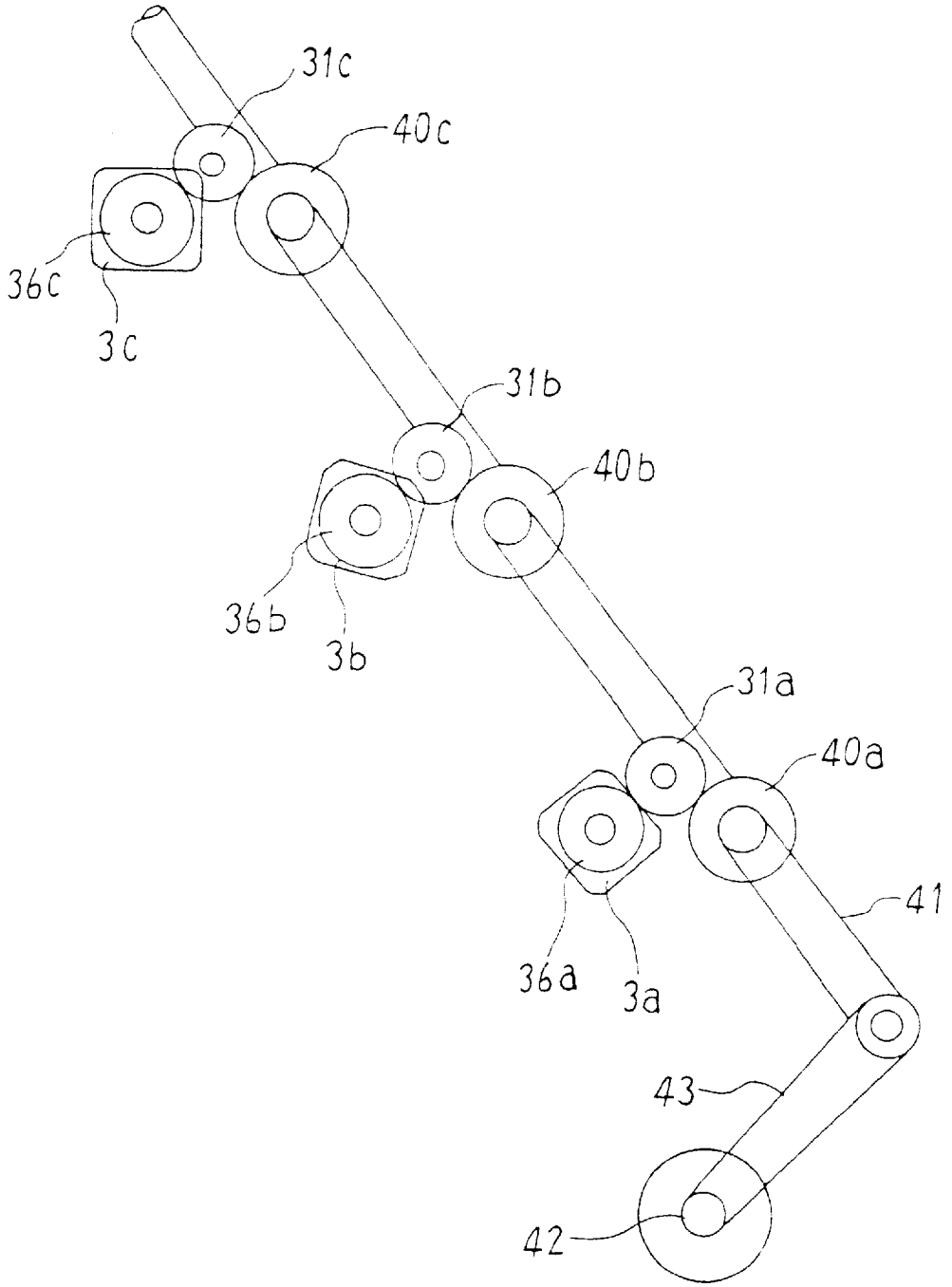
FIG. 4 is a view showing a driving system of a mechanism in FIG. 2.

FIG. 2 is a sectional view showing a medium insertion unit in FIG. 1. FIG. 3 is a top view of the medium insertion unit. FIG. 4 is a view showing a drive system of the medium insertion unit.

As illustrated in FIG. 3, a drive shaft 41 of the conveying roller 4 is provided with four conveying rollers 4*a*–4*d*. Three pieces of square rollers 3*a*–3*c* are provided anterior thereto. The drive shaft 41 is provided with three drive gears 40*a*–40*c*. Further, driven gears 36*a*–36*c* are fixed to the respective square rollers 3*a*–3*c*.

The drive gears 40*a*–40*c* drive the driven gears 36*a*–36*c* through idle gears 31*a*–31*c*. End portions 60 of the impingement plates 6 are disposed behind the conveying rollers 4*a*–4*c*. First sensors 12 for detecting the insertion of the medium are provided anterior to the square rollers 3*a*–3*c*. Second sensors 13 for detecting the impingement of the medium are provided anterior to the end portions 60 of the impingement plates 6.

As shown in FIG. 4,rotational phases of the three square rollers 3*a*–3*c* are different from each other. In this embodiment, the rotational phase of the second square roller 3*b* is shifted 22.5 degrees from the rotational phase of the first square roller 3*a*. The rotational phase of the third square roller 3*c* is shifted 22.5 degrees from the rotational phase of the second square roller 3*b*.

A driving force of a motor 42 is transmitted via a drive belt 43 to the drive shaft 41 of the conveying roller 4. This drive shaft 41 is provided with the drive gears 40*a*–40*c*, and therefore a rotating force of the drive shaft 41 is transmitted via the idle gears 31*a*–31*c* to the driven gears 36*a*–36*c*.

Accordingly, when the conveying rollers 4*a*–4*d* are rotated by the motor 42, the square rollers 3*a*–3*c* also rotate. Namely, the rotations of the conveying rollers 4*a*–4*d* and the rotations of the square rollers 3*a*–3*c* are given by the single motor 42.

As illustrated in FIG. 2, the drive shaft 41 of the conveying roller 4 is provided with a holder 32. This holder 32 is provided with the idle gears 31 (31*a*–31*c*), the driven gears 36*a*–36*c* and the square rollers 3 (3*a*–3*c*).

The holder 32 is supported on one end of an L-shaped drive lever 33 is fixed to a first rotary shaft 34. The other end of the drive lever 33 is linked to the holder 32 through a spring 35.

Hence, the holder 32 is so provided as to be rotatable about the drive shaft 41 of the conveying roller 4. Then, the holder 32 is biased clockwise by the spring 35. In this state, the square rollers 3 are positioned in an upper portion. When the first rotary shaft 34 is rotated clockwise, the drive lever 33 rotates clockwise. A return force of the spring 35 thereby weakens, and hence the holder 32 rotates counterclockwise about the drive shaft 41. The square rollers 3 thereby descend. The square rollers 3 are capable of conveying the inserted medium.

Then, reversely when the first rotary shaft 34 rotates counterclockwise, the drive lever 33 also rotates counterclockwise. The drive lever 33 thus pushes the holder 32 up, and consequently the holder 32 rotates clockwise about the drive shaft 41. Accordingly, the square rollers 3 move back to the previous upper portion. At this time, the square rollers 3 separate from the inserted medium, with the result that the medium is not conveyed.

A third sensor 14 detects a position of an upper edge of the medium in order to perform the printing on the medium. The other end of the impingement plate 6 is fixed to a third rotary shaft 61. When the third rotary shaft 61 rotates clockwise, the impingement plate 6 descends off a conveying path. Then, when the third rotary shaft 61 rotates counterclockwise, the impingement plate 6 is thrust into the conveying path.

The pinch roller 5 facing to the conveying roller 4 is supported by a plate spring 50. The other end of this plate spring 50 is fixed to a second rotary shaft 51. When the second rotary shaft 51 rotates clockwise, the pinch roller 5 is thrust into the conveying path. The pinch roller 5 thereby conveys the medium while the medium is sandwiched in between the conveying roller 4 and the pinch roller 5 itself. Then, when the second rotary shaft 51 rotates counterclockwise, the pinch roller 5 moves back off the conveying path. With this operation, the conveying roller 4 becomes incapable of executing the conveyance.

Figure 5:
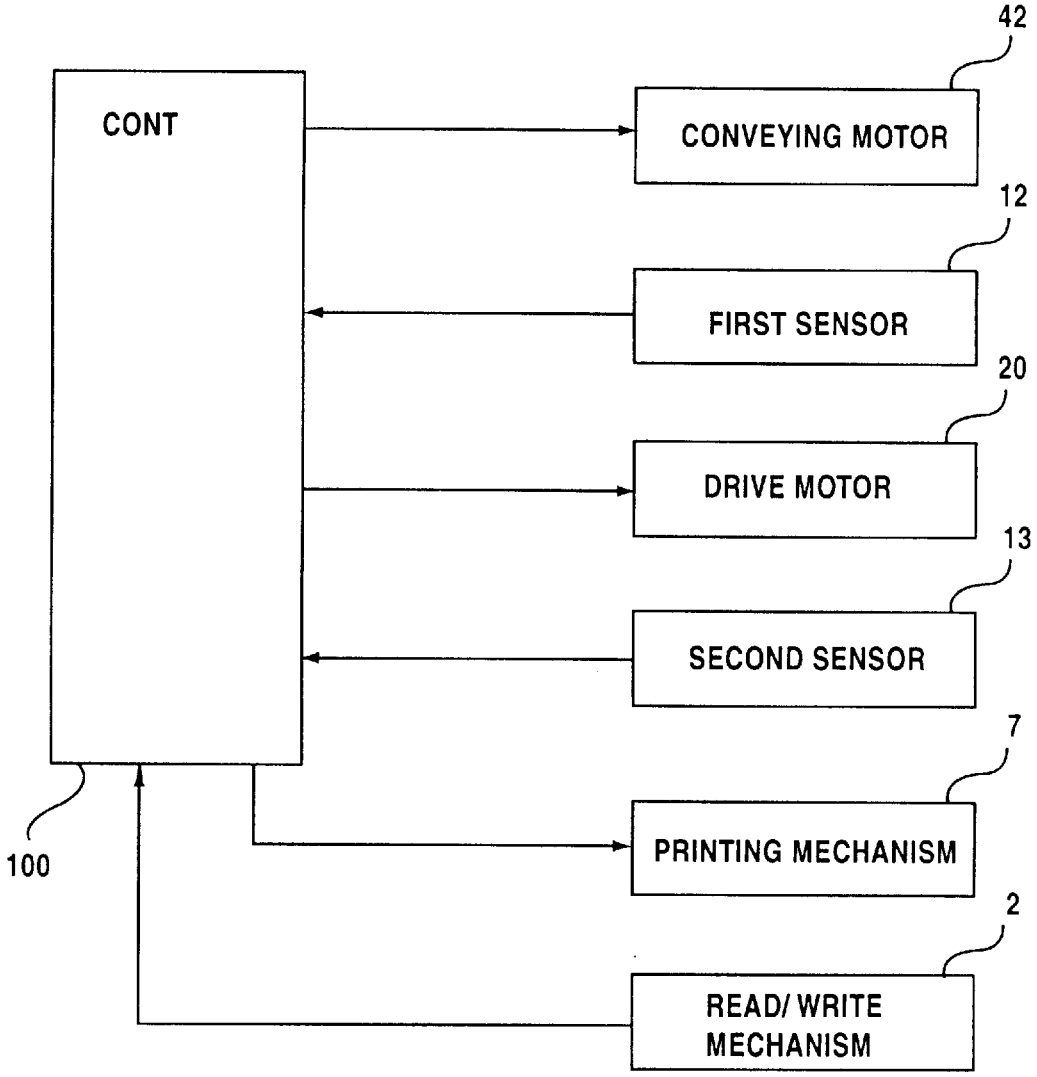
FIG. 5 is a block diagram in one embodiment of the present invention.

FIG. 5 is a block diagram in one embodiment of the present invention. Referring to FIG. 5, the same components as those shown in FIGS. 1 through 4 are marked with the same numerals.

The conveying motor 42 drives the above-described conveying roller 4 and the square roller 3. The first sensor 12 detects the insertion of the medium. A drive motor 20 operates an interlocking mechanism 22 which will be explained with reference to FIG. 11 and subsequent Figures. With this operation, the first to third rotary shafts 35, 51, 61 is operated, thereby making up-and-down motions of the square roller 3, the pinch roller 5 and the impingement plate 6.

The second sensor 13 detects that the medium impinges on the impingement plate 6. The printing mechanism 7 executes the printing on the inserted medium. A read/write mechanism 2 reads and writes the data from and to the magnetic stripe of the passbook.

A control circuit 100 is constructed of a microprocessor. The control circuit 100 controls the motors 42, 20 in accordance with outputs of the sensors 12, 13, and controls the printing mechanism 7 and the read/write mechanism 2.

Figure 6:
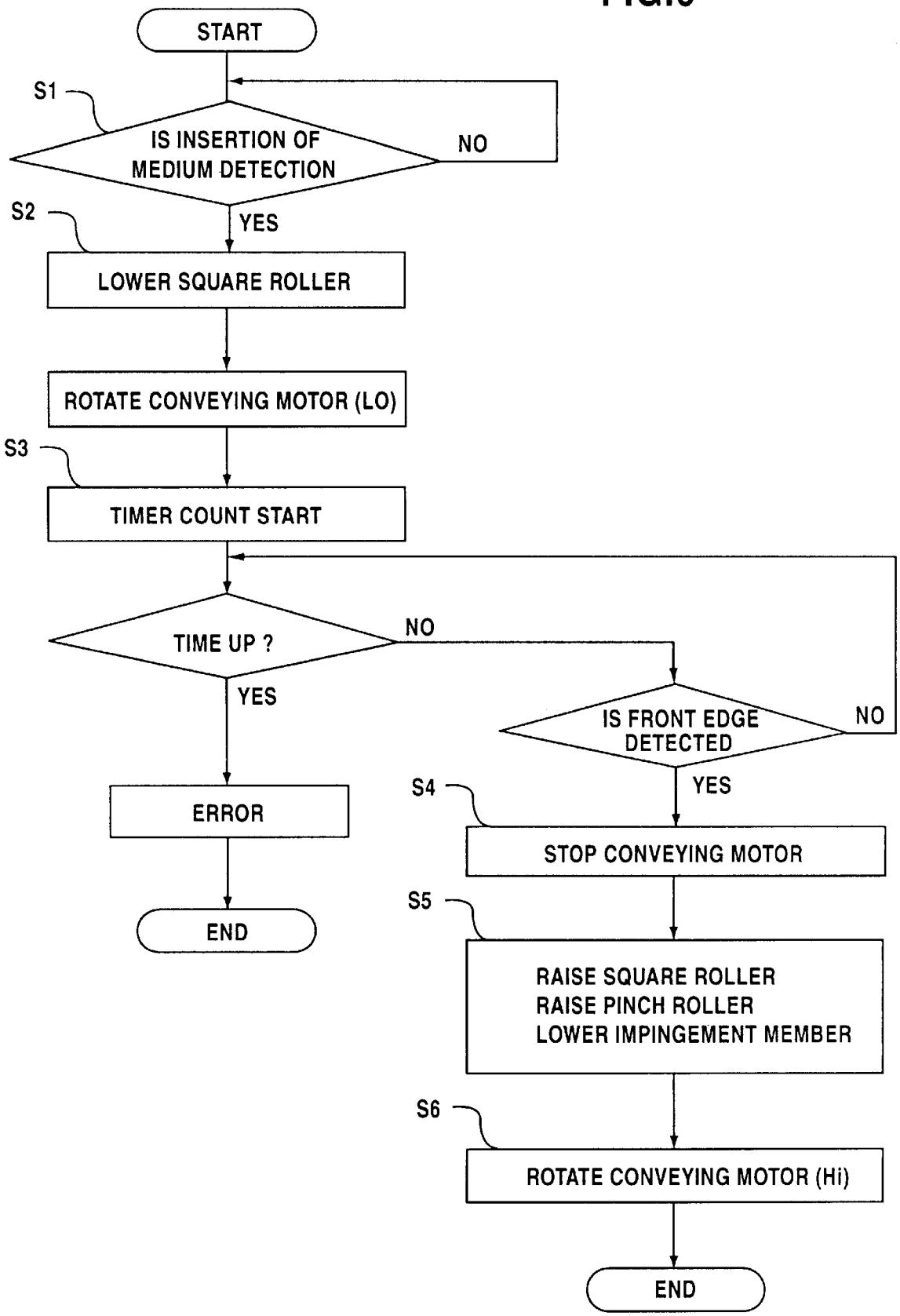
FIG. 6 is a flowchart showing operations in one embodiment of the present invention.

FIG. 6 is a flowchart of the operations in one embodiment of the present invention. FIGS. 7A through 7D are explanatory views showing how the medium is drawn in. FIGS. 8A to 8E are explanatory views showing operations of correcting a slant of the medium.

Figure 7A:
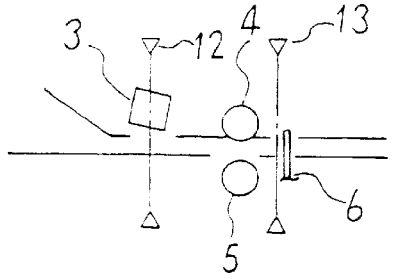
FIGS. 7A, 7B, 7C and 7D are explanatory views each showing a draw-in operation in the construction shown in FIG. 2.

(S1) In an initial state, as shown in FIG. 7A, the square roller 3 is in an ascent position. The pinch roller 5 is in a descent position. The impingement plate 6 is protruded into the conveying path. In this state, the control circuit 100 monitors an output of the first sensor 12.

Figure 7B:
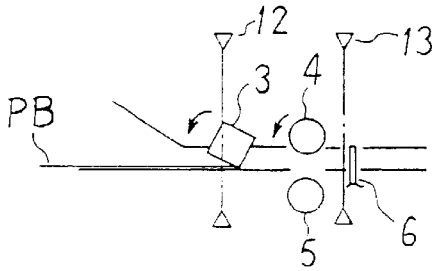

(S2) The control circuit 100, when detecting the medium from the output of the first sensor 12, recognizes that the medium has been inserted. The control circuit 100 operates the drive motor 20 and drives the interlocking mechanism 22 which will hereinafter be described. The square roller 3 is thereby lowered to a lower position. The control circuit 100 drives the conveying motor 42 at a low speed. As illustrated in FIG. 7B, the square roller 3 is thereby rotated. Thus, the square roller 3 conveys the inserted medium towards the impingement plate 6.

Further, as illustrated in FIG. 4, the conveying roller 4 is also rotated by the conveying motor 42. The pinch roller 5 is, however, in the descent position (retreat position), and therefore the conveying roller 4 performs no conveying operation. Consequently, only the impinging operation can be done by one conveying motor.

(S3) The control circuit 100 starts up a timer. The control circuit 100, if a predetermined impingement time of the timer does not yet elapse, monitors an output of the second sensor 13. The control circuit 100, when the output of the second sensor 13 indicates that the medium is detected, judges that the medium has impinged upon the impingement plate 6. Reversely, the control circuit 100, when the output of the second sensor 13 gives no indication of the medium having been detected within the impingement time of the timer, notifies the system of an error, thus finishing the processing.

(S4) When the second sensor 13 detects the medium, the control circuit 100 stops the conveying motor 42. The impingement operation ceases with this operation.

Figure 7C:
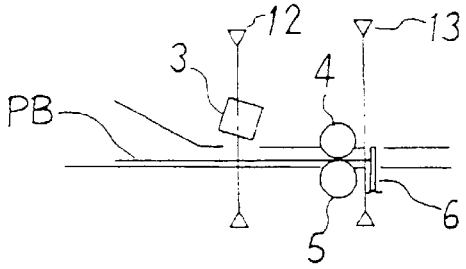

(S5) The control circuit 100 operates the drive motor 20 and the interlocking mechanism 22 which will be mentioned later on. As shown in FIG. 7C, upon this operation, the square roller 3 moves up to the ascent position. Then, the pinch roller 5 rises, whereas the impingement plate 6 lowers. The medium PB is thereby sandwiched in between the conveying roller 4 and the pinch roller 5.

Figure 7D:
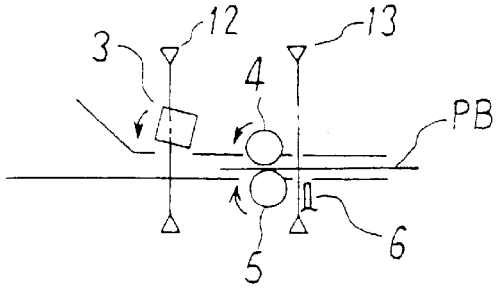
Figure 8A:
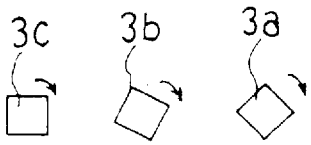
FIGS. 8A, 8B, 8C, 8D and 8E are explanatory views each showing a slant correcting operation in the construction shown in FIG. 2.
Figure 8B:
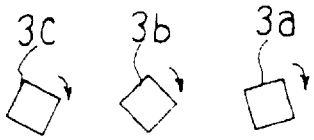
Figure 8C:
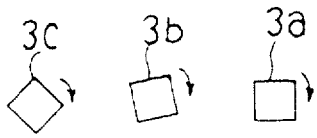
Figure 8D:
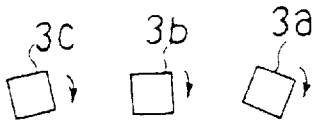
Figure 8E:
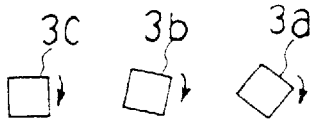
Figure 8E:
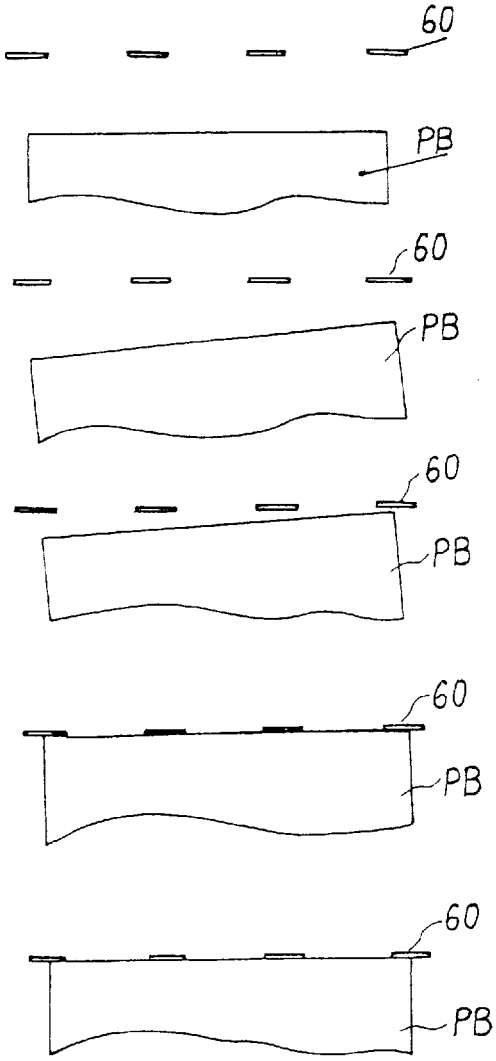

(S6) The control circuit 100 drives the conveying motor 42 at a high speed. The medium is thereby, as shown in FIG. 7D, conveyed toward the printing mechanism 7 at the high speed. At this time, as shown in FIG. 4, the square roller 3 is also rotated by the conveying motor 42. The square roller 3 is, however, in the ascent position (the retreat position) and does not therefore perform the conveying operation. Accordingly, only the conveying operation can be done by the single conveying motor 42.

This slant correcting operation will be further explained. As shown in FIG. 4, the three square rollers 3*a*–3*c* convey the medium and are, besides, different from each other in terms of their rotational phases. Therefore, as shown in FIGS. 8A to 8E, when the first square roller 3*a* conveys one side of the medium PB, one side of the medium PB impinges upon the impingement member 60. When the medium PB impinges thereon, the first square roller 3*a* slides. At this time, the second square roller 3*b* conveys the other side of the medium PB. Then, when the other side of the medium PB impinges on the impingement member 60, the second square roller 3*b* slides. The third square roller 3*c* operates in the same manner.

The right and left edges of the medium PB are thus conveyed with a time-lag, with the result that a temporary force for conveying the medium decreases. Hence, a thin medium can be prevented from being bounced back when in the impingement. Further, the right and left edges of the medium impinge on the impingement member 60, and therefore the slant thereof can be corrected. Even when thus operated, the conveying force when in the impingement does not change on the whole, so that the slant of a comparatively thick medium such as the passbook etc can be stably corrected.

Further, the square roller 3 is moved up and down, and the pinch roller 5 is also moved up and down. It is therefore feasible to perform the impinging operation of the square roller 3 and the conveying operation of the conveying roller 4 by the single conveying motor 42. This makes it possible to decrease the number of the drive motors and costs of the apparatus, and downsize the apparatus.

Moreover, when in the impingement, the conveying motor 42 is driven at the low velocity, and hence, even if the conveying motor 42 is used both for the impinging operation of the square roller 3 and for the conveying operation of the medium by the conveying roller 4, the conveying force of the square roller 3 can be reduced. When impinging, the thin medium can be prevented from being bounced back.

Figure 9:
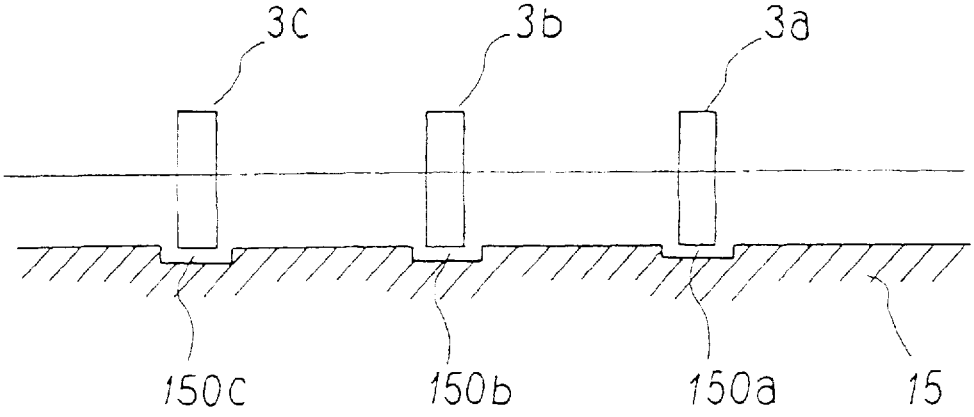
FIG. 9 is an explanatory view of a conveying guide in the construction shown in FIG. 2.

FIG. 9 is an explanatory view illustrating a conveyance guide in FIG. 2.

As shown in FIG. 2, a conveyance guide 15 is provided in a position bearing a face-to-face relationship with the square roller 3 and the conveying roller 4 as well. This conveyance guide 15 is formed with recessed portions 150 in positions facing to the square rollers 3. As illustrated in FIG. 9, the recessed portions 150*a*–150*c* are formed in the positions facing to the square rollers 3*a*–3*c*.

With this arrangement, the thin medium follows after the recessed portions 150*a*–150*c* and thus flexes. Therefore, the force by which the square rollers 3*a*–3*c* convey the thin medium is reduced. On the other hand, the thick medium does not follow after the recessed portions 150*a*–150*c*, so that the force by which the square rollers 3*a*–3*c* convey the thick medium is not reduced.

Hence, the force by which the square rollers convey the thin medium can be decreased. This makes it feasible to prevent the thin medium from being bounced back when in the impingement caused by the square rollers. While on the other hand, the force by which the square rollers convey the thick medium is not reduced, and therefore the slant of the thick medium can be stably corrected.

Figure 10A:
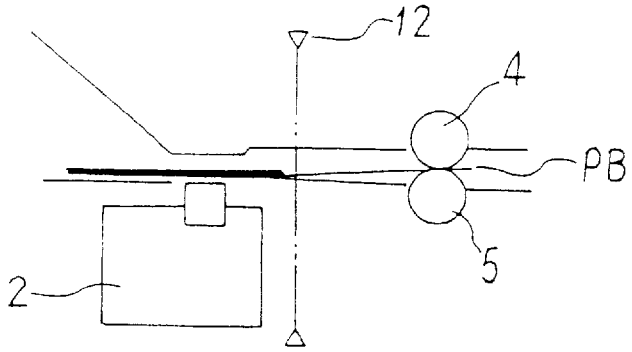
FIGS. 10A, 10B, 10C and 10D are explanatory views each showing a read/write operation in the construction shown in FIG. 2.

FIGS. 10A though 10D are explanatory views showing the read/write operation in the construction shown in FIG. 1. In this embodiment, the first sensor 12 is utilized also for detecting a position of the lower edge of the passbook PB.

Figure 10B:
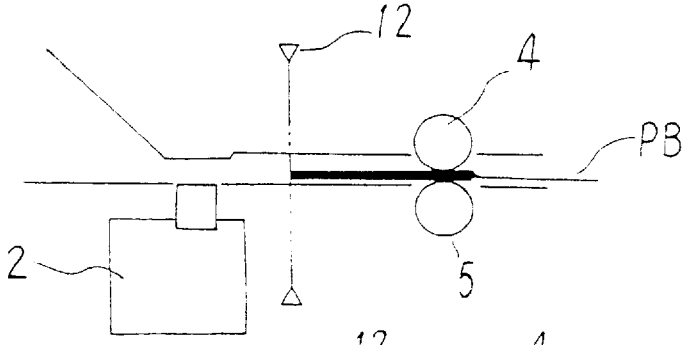

As previously shown in FIG. 7C, the inserted passbook PB is sandwiched in between the conveying roller 4 and the pinch roller 5. Then, as shown in FIG. 10A, the conveying roller 4 and the pinch roller 5 convey the passbook PB in the right direction. As shown in FIG. 10B, when the first sensor 12 detects the lower edge of the passbook PB, the control circuit 100 stops the conveying motor 42. With this stoppage, the conveying roller 4 is stopped.

Figure 10C:
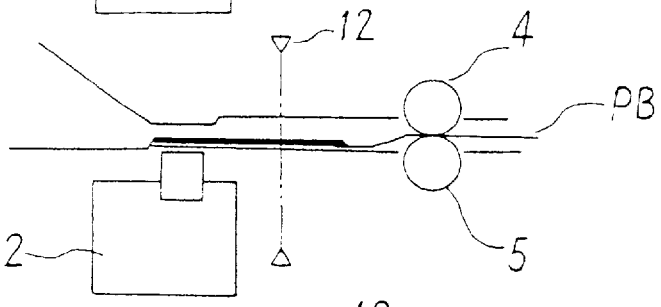
Figure 10D:
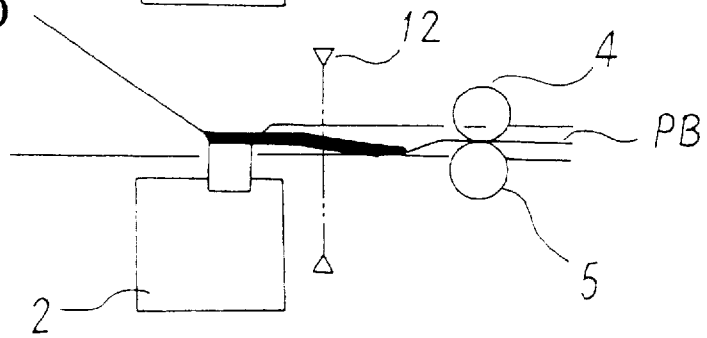

The control circuit 100 controls the conveying motor 42 to make reverse rotations by a given quantity on the basis of the above position of the lower edge. With these rotations, as shown in FIG. 10C, the conveying roller 4 is rotated reversely, whereby the magnetic stripe of the passbook PB is positioned at the magnetic head of the read/write mechanism 2. Then, as illustrated in FIG. 10D, the magnetic head of the read/write mechanism 2 execute the read/write operations on the magnetic stripe of the passbook PB.

For example, immediately after correcting the slant of the inserted passbook PB, the data on the magnetic strip of the passbook might be read in some cases. Then, a printing position is determined based on the data on the magnetic strip. Further, the data (the number of bank account etc) on the magnetic stripe are transmitted to a host computer, thereby obtaining print data from the host computer and executing the printing.

Thus, the first sensor 12 for detecting the insertion of the medium can be utilized for detecting a fiducial position of the medium. Particularly, this construction is effective in terms of reading the data from the medium immediately after the medium has been inserted.

Figure 11:
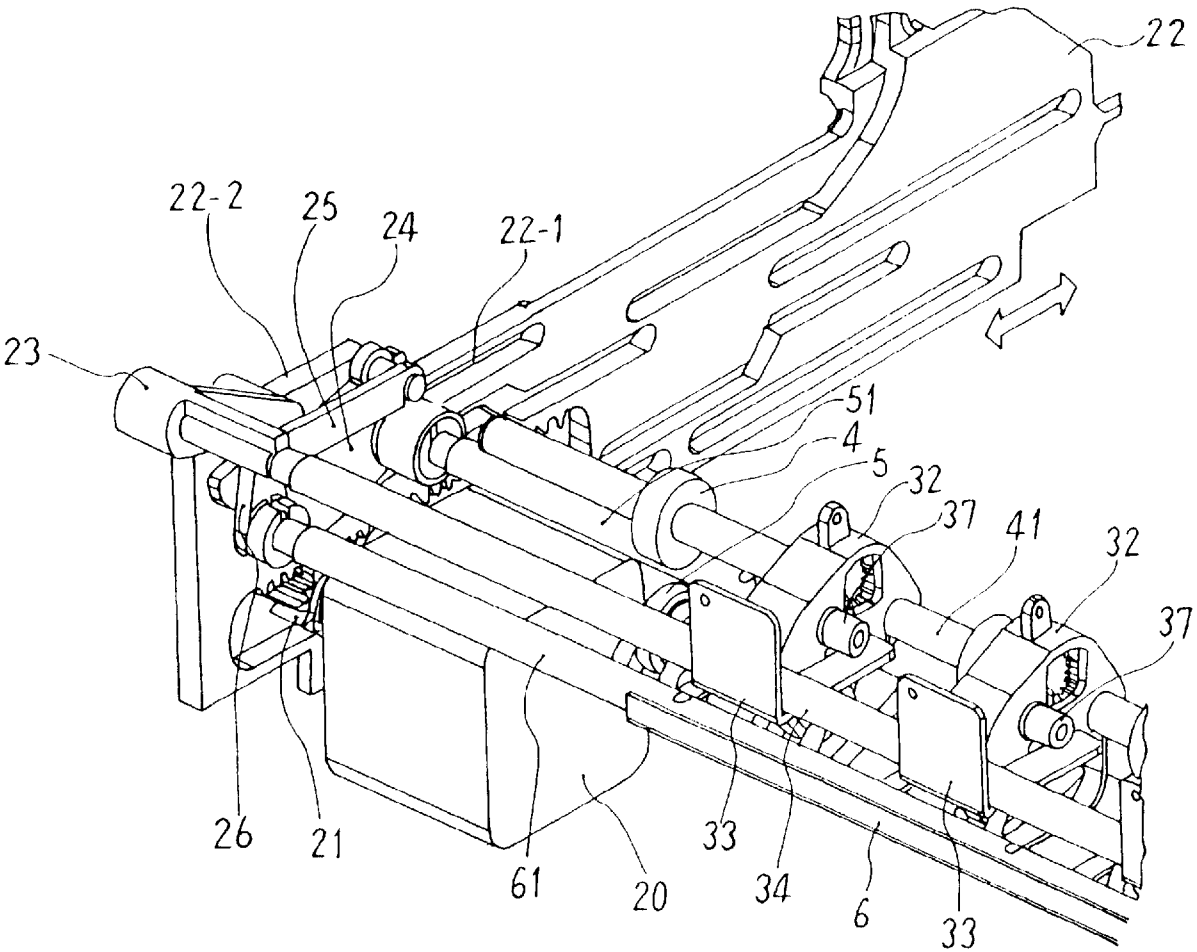
FIG. 11 is a perspective view of an interlocking mechanism in the construction shown in FIG. 2.
Figure 12:
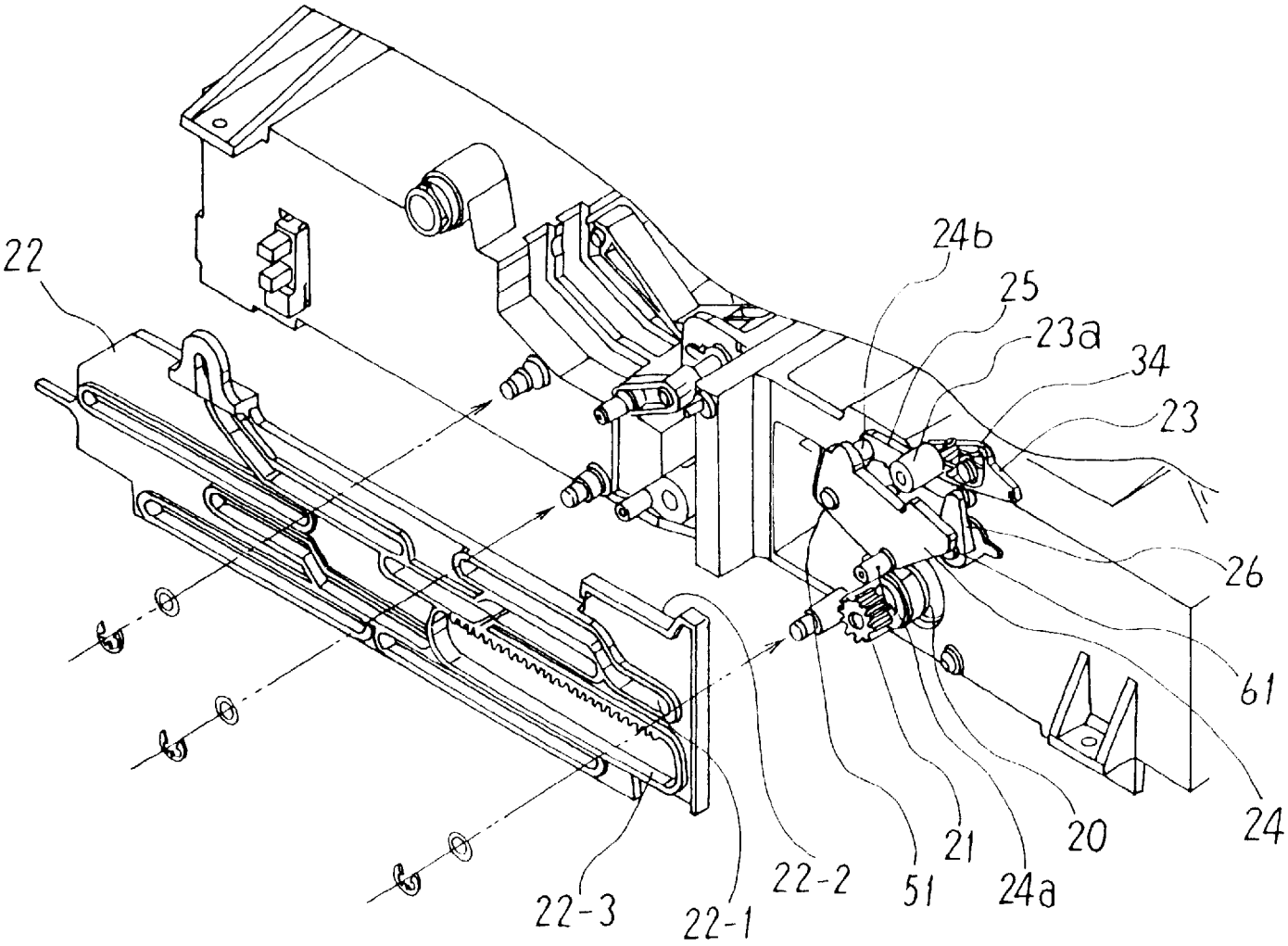
FIG. 12 is an exploded view of the interlocking mechanism in a construction shown in FIG. 11.
Figure 13:
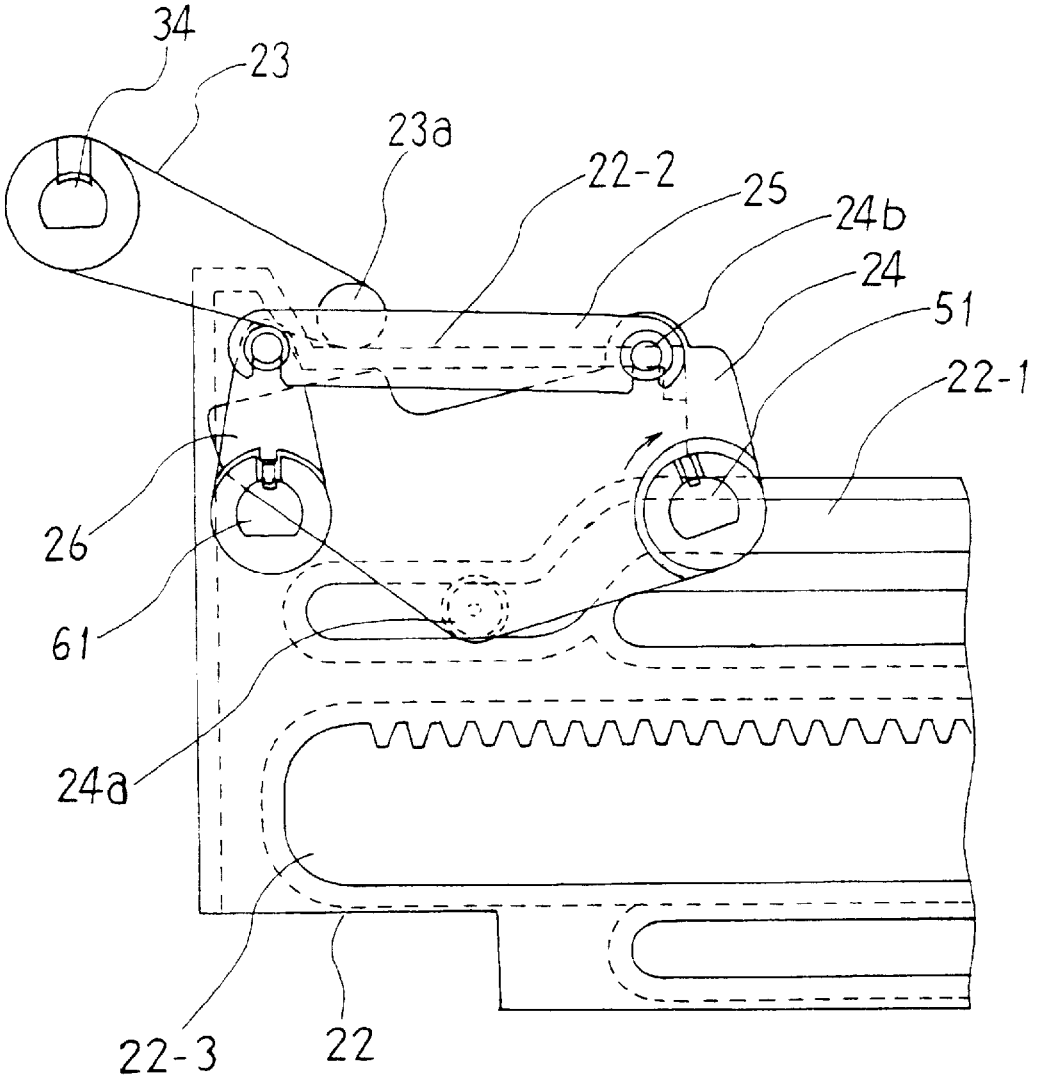
FIG. 13 is a cross sectional view of the interlocking mechanism in the construction shown in FIG. 11.
Figure 14:
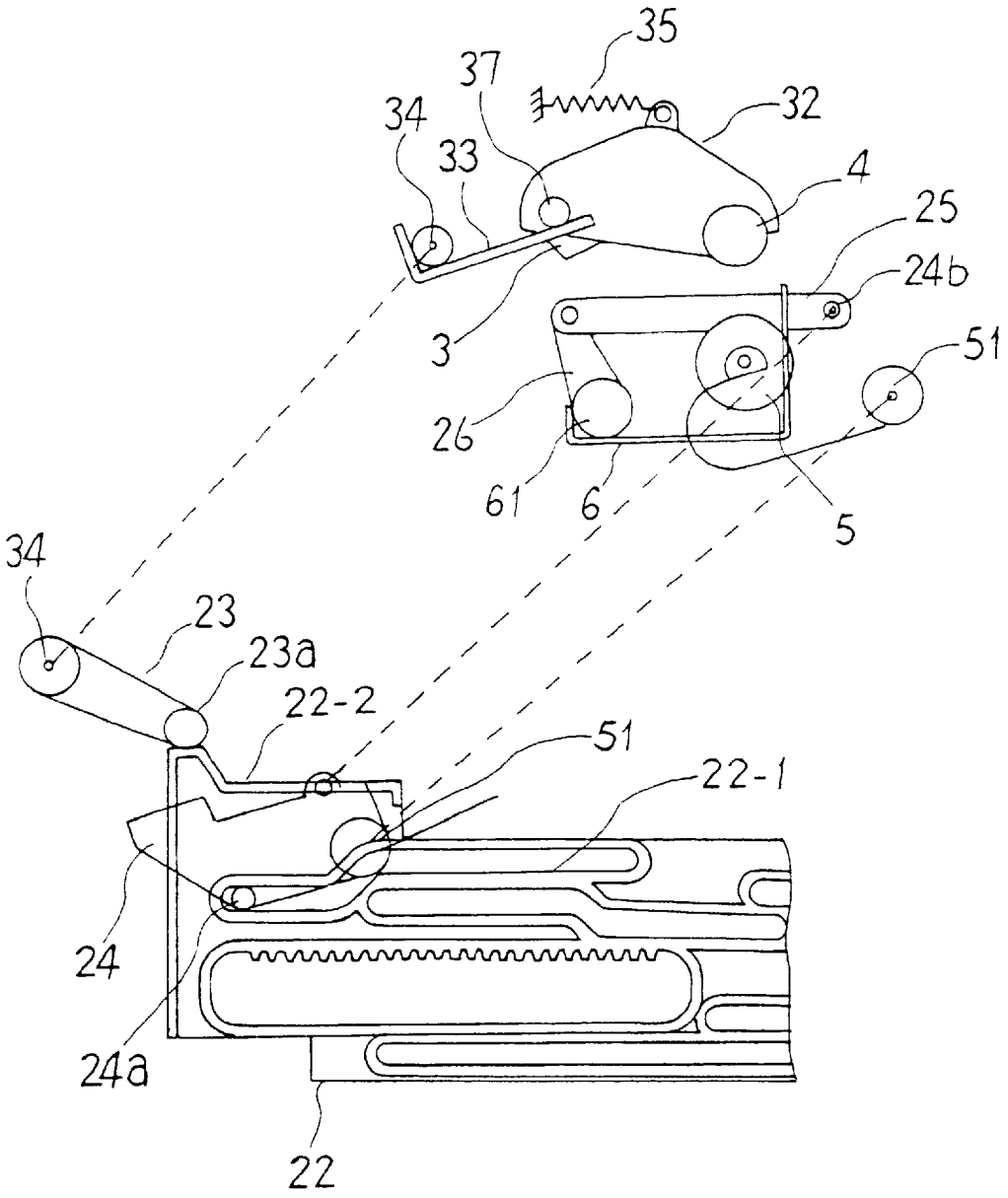
FIG. 14 is an explanatory view (part 1) of the interlocking mechanism shown in FIG. 11.
Figure 15:
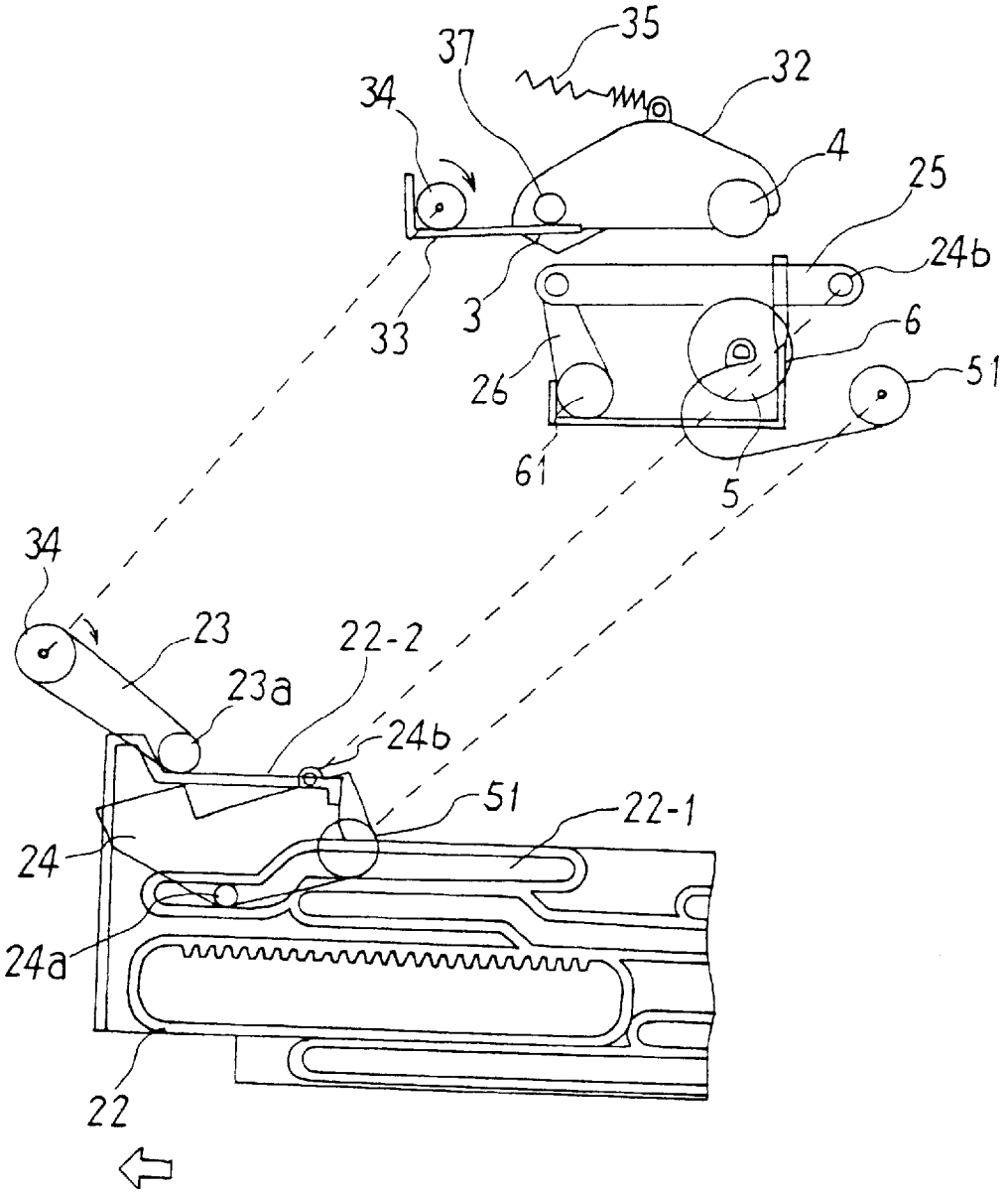
FIG. 15 is an explanatory view (part 2) of the interlocking mechanism shown in FIG. 11.
Figure 16:
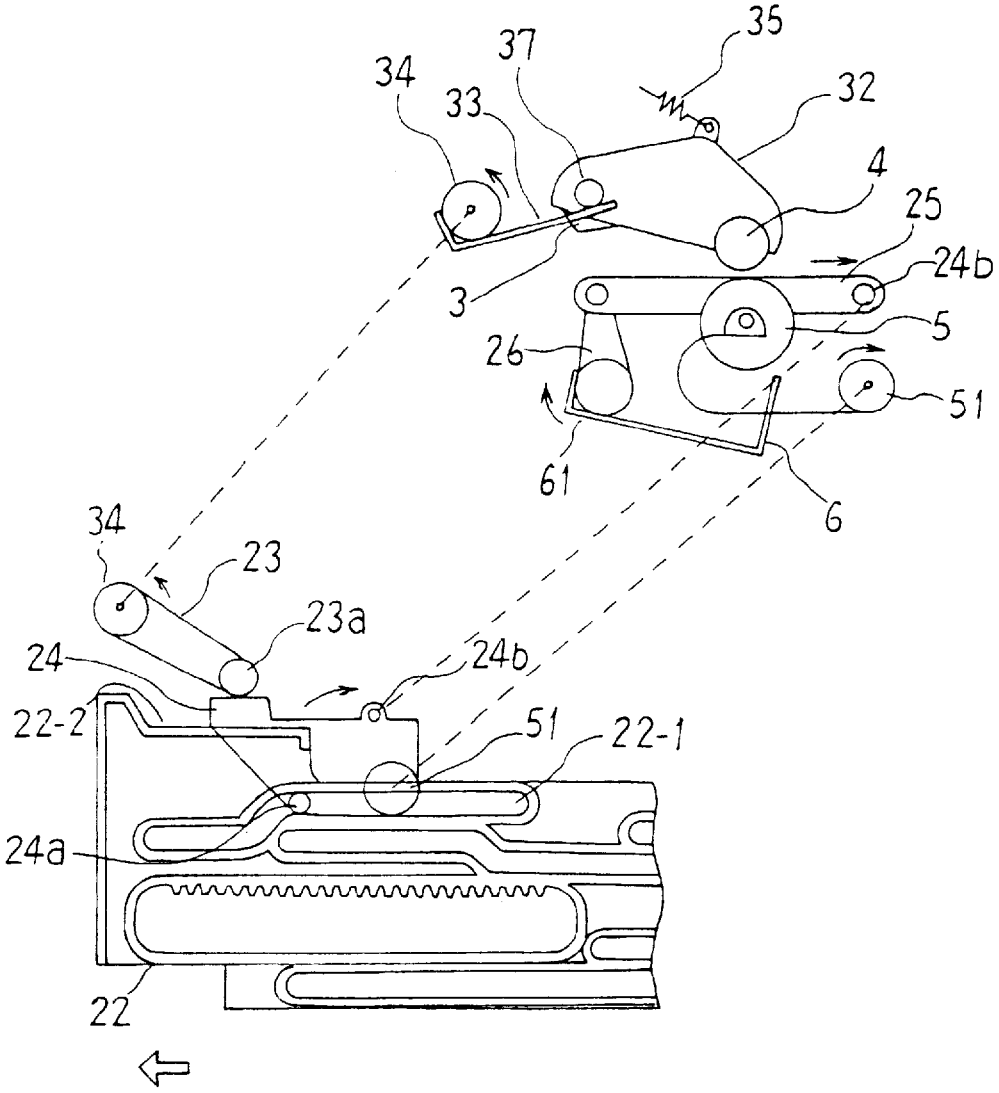
FIG. 16 is an explanatory view (part 3) of the interlocking mechanism shown in FIG. 11.

FIG. 11 is a perspective view showing the interlocking mechanism. FIG. 12 is an exploded view of the interlocking mechanism. FIG. 13 is a cross sectional view of the interlocking mechanism. FIGS. 14 through 16 are explanatory views of the interlocking mechanism.

As illustrated in FIG. 11, a first rotary lever 23 is fitted to a tip of the first rotary shaft 34. A drive lever 33 is fixed to the first rotary shaft 34. The drive lever 33 is supported by a protruded member 37 provided on a holder 32. The holder 32 is rotatably held by a drive shaft 41.

The holder 32 is provided with the drive gear 40, the idle gear, the driven gear 36 and the square roller 3 that have been explained referring to FIG. 2. Accordingly, as explained in FIG. 2, the square roller 3 is moved up and down with the rotations of the first rotary shaft 34.

As shown in FIGS. 11 and 12, an interlocking block 24 is provided at a tip of a second rotary shaft 51 provided with the pinch roller 5. The interlocking block 24 includes a guide roller 24*a*. Further, a connection link 25 is secured to an auxiliary shaft 24*b* of the interlocking block 24.

The impingement plate 6 is attached to a third rotary shaft 61. A third rotary lever 26 is fitted to a tip of the third rotary shaft 61. The third rotary lever 26 is connected to the connection link 25.

A plate cam 22 includes a first guide hole 22-1, a second guide member 22-2 and a drive hole 22-3. The drive motor 20 is provided with a drive gear 21. The drive gear 21 meshes with a gear of the drive-hole 22-3 of the plate cam 22. Accordingly, with the rotations of the drive motor 20, the plate cam 22 moves in an arrowed direction in FIG. 11.

As shown in FIG. 13, a guide roller 23*a* is secured to the first rotary lever 23 fitted to the first rotary shaft 34. The guide roller 23*a* is guided by the guide member 22-2 of the plate cam 22. Accordingly, the first rotary shaft 34 rotates corresponding to the up-and-down motions of the guide roller 23*a*.

A guide roller 24*a* is secured to the interlocking block 24 fitted to the second rotary shaft 51. The guide roller 24*a* is guided by the guide hole 22-1 of the plate cam 22. Accordingly, the second rotary shaft 51 rotates corresponding to the up-and-down motions of the guide roller 24*a*.

The third rotary lever 26 fitted to the third rotary shaft 61 is connected via the connection link 25 to the auxiliary shaft 24*b* of the interlocking block 24. Accordingly, the third rotary shaft 61 rotates corresponding to the up-and-down motions of the guide roller 24*a* of the interlocking block 24.

The operations thereof will be described with reference to FIGS. 14 through 16.

In the initial state, as shown in FIG. 14, the plate cam 22 is in a first position (an initial position). In this position, the guide roller 23*a* of the rotary lever 23 is located in a high position of the guide member 22-2. Therefore, the drive lever 33 secured to the first rotary shaft 34 thrusts up the protruded member 37 of the holder 32. The square roller 3 is thereby located in the ascent position.

Further, the guide roller 24*a* of the interlocking block 24 is located in a lower position of the guide hole 22-1 of the plate cam 22. Hence, the pinch roller 5 is in the descent position, and the impingement plate 6 protrudes into the conveying path.

As illustrated in FIG. 15, the control circuit 100 operates the drive motor 20, whereby the plate cam 22 is moved to a second position. The guide roller 23*a* of the rotary lever 23 is thereby located in a low position of the guide member 22-2 of the plate cam 22. Therefore, the rotary lever 23 rotates clockwise. With these rotations, the holder 32 rotates counterclockwise about the drive shaft 41, and hence the square roller 3 descends to a low position. This enables the square roller 3 to make the impinging operation as shown in FIG. 7B.

At this time, the guide roller 24*a* of the interlocking block 24 is located in the low position of the guide hole 22-1 of the plate cam 22. Therefore, the pinch roller 5 is in the descent position, and the impingement plate 6 protrudes into the conveying path.

Further, as shown in FIG. 4, the conveying roller 4 is also rotated by the conveying motor 42. The pinch roller 5 is, however, in the descent position (the retreat position), and hence the conveying roller 4 does not perform the conveying operation. Only the impinging operation can be therefore done by the single conveying motor.

When the second sensor 13 detects the medium, the control circuit 100 stops the conveying motor 42. The impingement operation ceases with this operation. Then, as shown in FIG. 16, the control circuit 100 operates the drive motor 20, whereby the plate cam 22 is moved to a third position.

With this operation, the guide roller 24*a* of the interlocking block 24 is located in the high position of the guide hole 22-2 of the plate cam 22. Consequently, the second rotary shaft 51 rotates clockwise. Accordingly, the pinch roller 5 rises. The medium is thereby sandwiched in between the conveying roller 4 and the pinch roller 5.

Simultaneously with this operation, the auxiliary shaft 24*b* of the interlocking block 24 moves in the right direction in the Figure. With this movement, the connection link 25 moves in the right direction in the Figure, and the third rotary lever 26 rotates clockwise. The impingement plate 6 thereby moves back off the conveying path.

At this time, the guide roller 23*a* of the rotary lever 23 gets on the interlocking block 24 and is located in the high position. The rotary lever 23 thereby rotates counterclockwise, and hence the first rotary shaft 34 also rotates counterclockwise. Accordingly, the drive lever 33 rotates counterclockwise to push up the protruded member 37 of the holder 32. With this operation, the square roller 3 of the holder 32 rises to the ascent position.

As discussed above, the control circuit 100 drives the conveying motor 42 at the high velocity. The medium is thereby, as shown in FIG. 7D, conveyed toward the printing mechanism 7 at the high speed. At this time, as illustrated in FIG. 4, the square roller 3 is rotated by the conveying motor 42. The square roller 3 is, however, in the ascent position (the retreat position), and therefore the square roller 3 does not implement the conveying operation. Accordingly, only the conveying operation can be done by the single conveying motor 42.

Thus, it is feasible to actualize the accessing/retreating motions of the three members (the square roller 3, the pinch roller 5 and the impingement plate 6) by use of the one driving source. Therefore, the costs of the apparatus can be reduced, and besides the apparatus can be downsized. Further, since the interlocking mechanism involves the use of the cam, the interlocking operation can be actualized with a simple construction.

Figure 17:
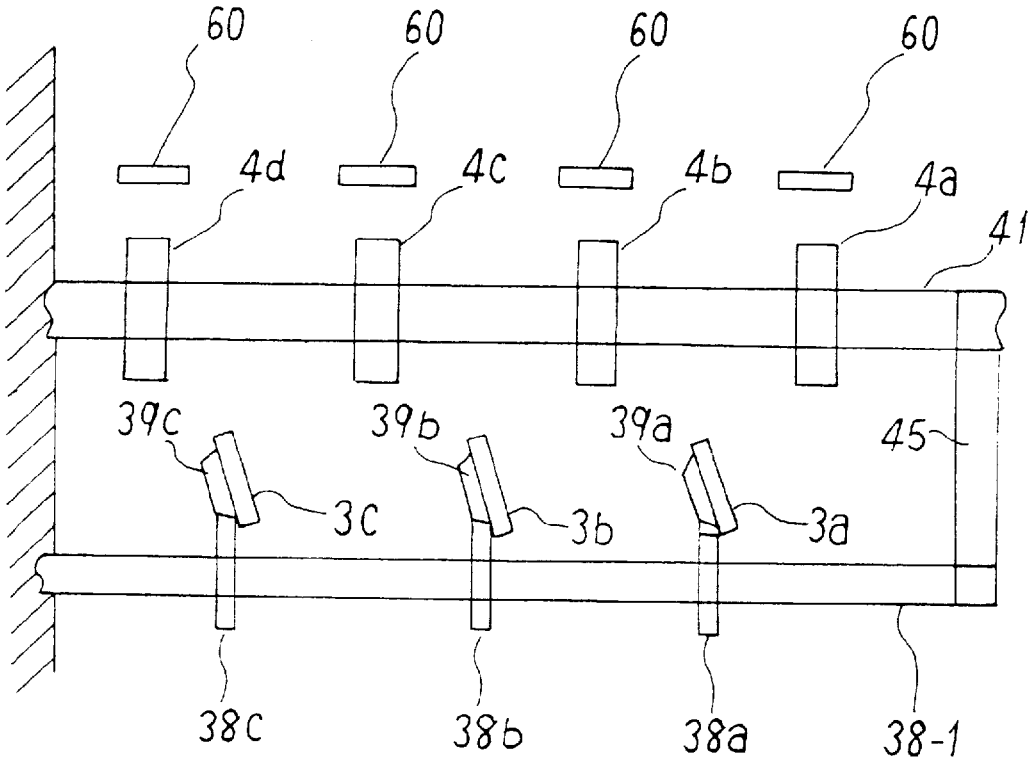
FIG. 17 is a top view of another slant correcting roller according to the present invention.
Figure 18:
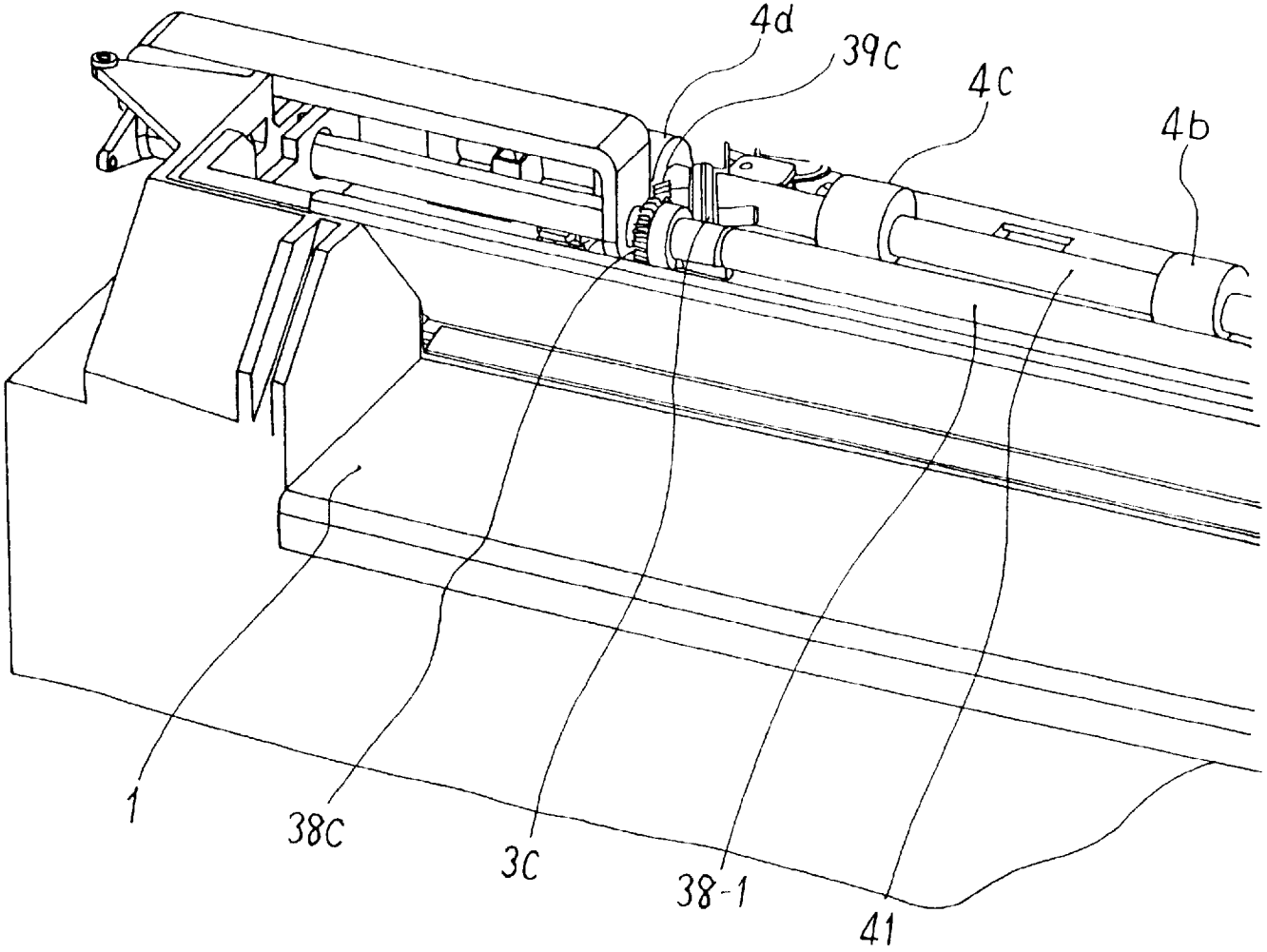
FIG. 18 is a perspective view of another slant correcting roller.
Figure 19:
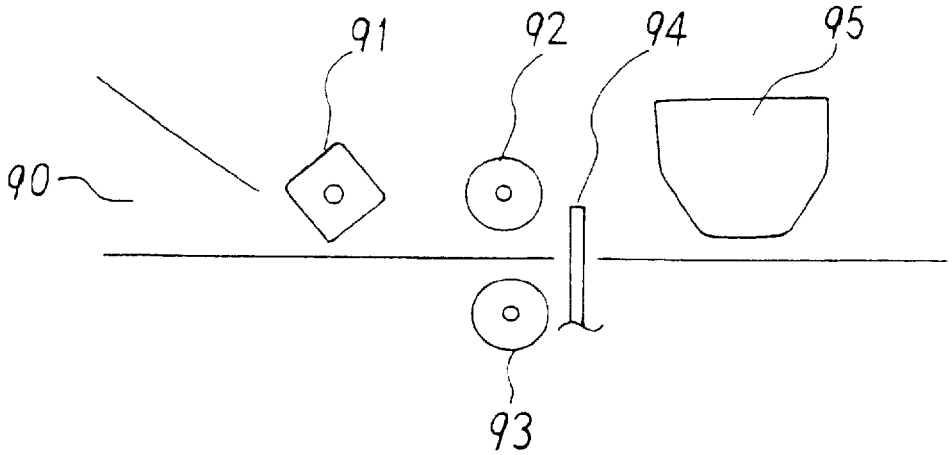
FIG. 19 PRIOR ART
FIG. 19 is an explanatory view of the prior art.

FIG. 17 is a top view showing a slant correcting roller in another embodiment of the present invention. FIG. 18 is a perspective view of the slant correcting roller in another embodiment of the present invention.

In accordance with this embodiment, the square rollers 3*a*–3*c* are provided obliquely to the medium conveying direction. If constructed in this manner, the directions of the impingements by the square rollers 3*a*–3*c* are a forward direction (a direction of the impingement plate) and a crosswise direction (a direction of the side wall). Therefore, the impingements in the forward and crosswise directions can be made by square rollers.

In this embodiment also, the square rollers 3*a*–3*c* are driven by use of the drive motor for the conveying rollers 4*a*–4*d*. A drive shaft 38-1 of the square roller is provided. A driving force of the drive shaft 41 for the conveying rollers 4*a*–4*d* is transmitted via a timing belt 45 to the drive shaft 38-1. Drive gears 38*a*–38*c* are fitted to the drive shaft 38-1. Gears 39*a*–39*c* fitted to the square rollers 3*a*–3*c* mesh with the drive gears 38*a*–38*c*.

Therefore, the impingements by the square rollers and the conveyance by the conveying roller can be executed by the single drive motor with the aid of the up-and-down moving mechanism for the square rollers and the up-and-down moving mechanism of the pinch roller which have been described above.

In addition to the embodiments discussed above, the present invention can be modified as follows:

(1) In the embodiments discussed above, the polygonal roller has been explained in the form of the square roller but may include a triangular roller and a pentagonal roller etc as usable rollers.

(2) The interlocking mechanism has been explained in the form of the plate cam but may involve the use of other link mechanisms.

(3) The printing apparatus has been described in the form of the printer apparatus for financial institutes but is applicable to printer apparatuses for other applications.

The present invention has been described so far by way of the embodiments but may be modified in many forms within the range of the gist of the present invention, and those modifications are not excluded from the scope of the present invention.

As discussed above, according to the present invention, the following effects are exhibited.

(1) The plurality of polygonal rollers are provided as the slant correcting rollers, and hence the slant of the medium having a large or small width can be stably corrected.

(2) The rotational phases of the plurality of polygonal rollers are set different from each other, so that the right and left edges of the medium can be conveyed with the time-lag by the small conveying force. Therefore, the thin medium can be prevented from being bounced back when in the impingement, and the slant of the thick or thin medium can be corrected with the stability.

What is claimed is:

1. A printer apparatus for executing a print on a medium inserted from an insertion port, comprising:

a slant correction mechanism for correcting a slant of the medium inserted through said insertion port;

a conveying roller for conveying the medium inserted through said port, the slant of which is to be corrected; and a printing mechanism for executing the print on the medium conveyed by said conveying roller, said slant correction mechanism including:

a plurality of polygonal rollers mounted on a single roller shaft and aligned with said sort through which said medium is inserted and having rotational phases different from each other, for conveying the medium; and an impingement member upon which the medium conveyed by said polygonal rollers is impinged.

2. A printer apparatus for executing a print on a medium inserted from an insertion port, comprising:

a slant correction mechanism for correcting a slant of the medium inserted through said insertion port;

a conveying roller for conveying the medium inserted through said port, the slant of which is to be corrected; and a printing mechanism for executing the print on the medium conveyed by said conveying roller, said slant correction mechanism including:

a plurality of polygonal rollers mounted on a single rotary shaft and aligned with said port through which said medium is inserted and having rotational phases different from each other, for conveying the medium; and an impingement member upon which the medium conveyed by said polygonal rollers is impinged; and further comprising;

a first mechanism for moving said plurality of polygonal rollers up and down;

a second mechanism for retreating said conveying roller;

a third mechanism for retreating said impingement member; and a single driving mechanism for driving said polygonal rollers and said conveying roller.

3. The printer apparatus according to claim 1, further comprising conveying guides facing to said plurality of polygonal rollers, said conveying guides being formed with recessed portions in positions facing to said polygonal rollers.

4. The printer apparatus according to claim 1, further comprising:

a first mechanism for moving said plurality of polygonal rollers up and down;

a second mechanism for retreating said conveying roller;

a third mechanism for retreating said impingement member; and a single driving mechanism for driving said polygonal rollers and said conveying roller.

5. The printer apparatus according to claim 4, further comprising:

first detecting means for detecting an insertion of the medium into the medium insertion port;

second detecting means for detecting that the medium impinges upon said impingement member; and controlling means for controlling said first mechanism, said second mechanism, said third mechanism and said driving mechanism in accordance with an output of said first detecting means and an output of said second detecting means, wherein said controlling means lowers said plurality of polygonal rollers and thereafter rotates said polygonal rollers in accordance with the output of said first detecting means, and raises said polygonal rollers, lowers said impingement member and operates said conveying roller in accordance with the output of said second detecting means.

6. The printer apparatus according to claim 4, further comprising controlling means for controlling said driving mechanism slow when the slant is corrected by said polygonal rollers and controlling said driving mechanism fast when the medium is conveyed by said conveying roller.

7. The printer apparatus according to claim 4, further comprising an interlocking mechanism for interlocking said first mechanism, said second mechanism and said third mechanism.

8. The printer apparatus according to claim 7, wherein said interlocking mechanism includes a cam for interlocking said first mechanism, said second mechanism and said third mechanism, and driving means for driving said cam.

* * * * *

UNITED STATES PATENT AND TRADEMARK OFFICE

CERTIFICATE OF CORRECTION

PATENT NO. : 5,873,664
DATED : February 23, 1999
INVENTOR(S) : Umeno

It is certified that error appears in the above-identified patent and that said Letters Patent is hereby corrected as shown below:

Please change the last name of the inventor from "UMEMO" TO

--UMENO--

Signed and Sealed this

Twelfth Day of June, 2001

Nicholas P. Godici

*Attest:*

*Attesting Officer*

NICHOLAS P. GODICI
*Acting Director of the United States Patent and Trademark Office*